US007066829B1

(12) United States Patent
Lister

(10) Patent No.: US 7,066,829 B1
(45) Date of Patent: Jun. 27, 2006

(54) GOLF PUTTING ALIGNMENT SYSTEM

(76) Inventor: Gary Rae Lister, 301 Hemlock Street, Cultus Lake, B.C. (CA) V2R 4Y7

( * ) Notice: Subject to any disclaimer, the term of this patent is extended or adjusted under 35 U.S.C. 154(b) by 0 days.

(21) Appl. No.: 10/019,435

(22) PCT Filed: Aug. 28, 2000

(86) PCT No.: PCT/CA00/00971

§ 371 (c)(1),
(2), (4) Date: Dec. 31, 2001

(87) PCT Pub. No.: WO01/74456

PCT Pub. Date: Oct. 11, 2001

(51) Int. Cl.
*A63B 53/02* (2006.01)

(52) U.S. Cl. ..... 473/314; 473/313; 473/340

(58) Field of Classification Search ..... 473/238, 473/237, 251, 252, 253, 254
See application file for complete search history.

(56) References Cited

U.S. PATENT DOCUMENTS 1,631,504 A * 6/1927 Redman ..... 473/313
4,128,244 A * 12/1978 Duclos ..... 473/242
5,690,556 A * 11/1997 Condon ..... 473/252
5,704,851 A * 1/1998 Lucetti ..... 473/328
5,755,625 A * 5/1998 Jackson ..... 473/314

* cited by examiner

*Primary Examiner*—Glenn Caldarola
*Assistant Examiner*—Tom Duong
(74) *Attorney, Agent, or Firm*—Vermette & Co.

(57) ABSTRACT

A golf putter alignment system in which a putter has a centerline mark and the putter shaft is joined to the putter head near the toe extending upwardly and is then angled towards the golfer. Vertical alignment of the marks on the top of the putter head and the shaft, and the golfer's eyes over the centerline mark on the putter head and the mark on the upper portion of the shaft with the striking plate of the putter head square to the direction of intended travel completely aligns putter and golfer for a putt.

3 Claims, 3 Drawing Sheets

GOLF PUTTING ALIGNMENT SYSTEM

TECHNICAL INVENTION

The invention relates to the game of golf and more importantly to a golf putter having an alignment arrangement based on the position of the shaft over a center line mark on the putter head.

BACKGROUND OF THE INVENTION

Putting plays an important role in a successful round of golf. In order to technically execute a proper putt a golfer's eyes must be properly positioned relative to the ball and to an intended line of the putt. A putter has a striking face, which should be aligned square to the desired path of the ball travel.

It is known that an alignment centerline is placed on the top surface of the putter to aid a golfer in positioning the face of a putter square to the target line of the putt. Typically, this centerline or aiming line is perpendicular to the face and is positioned at the desired area of putter to ball impact.

In addition to having the putter face aligned to the intended target line a golfer must be in the proper position relative to the ball to have proper golf technique. It is well-known that the proper putting position requires the golfer to have their eyes directly over the centerline of the putter head, the ball, and the target line or aim line, (see, for example, "Dave Pelz's Putting Bible" (June 2000) by Dave Pelz). The target line is a line extending through the ball, representing the intended path of travel of the ball when putted. The centerline of the putter head indicates the desired point of putter to ball impact. When a golfer has his eyes over the centerline of the putter head, the ball, and the target line, it is commonly referred to in golf as having "your eyes over the ball." The eyes of the golfer should be over the ball so that when the ball is struck the putter is returned to the proper position to send the ball on its desired target line. This is critical because if a golfer is not in the proper putting position they will compensate their stroke path to what they see; resulting in a pushed or a pulled putt. Tests have proven that golfers with a push stroke subconsciously aim to the left, while those with a pull stroke aim right. Having the eyes inside or outside the centerline/target-line causes these errant stroke paths (see, for example, "The First Fundamental of Putting by Dave Pelz—Golf Magazine June 1995). The body and hands will respond to what the eyes see. Thus eye-hand coordination is very import when putting a golf ball.

It takes regular practice to develop a putting stance and stroke to propel a golf ball on its intended target line. Golfers of all skill levels have been shown to find this eye position and putter alignment difficult to maintain over time. In the prior art, to check eye position, you could either drop a ball from beneath your eye line or have a friend stand behind you and say when a plumb line hanging from a point below your eyes hovers directly over your aimline.

An object of the invention is to provide a putter that can be used to indicate when proper alignments have been attained for stroking a golf ball.

A putter that uses a shaft to facilitate alignment of a putter head aid a golfer's head relative to a ball and a desired path of ball travel is shown, for example, in the following U.S. Pat. No. 5,564,990—Weeks.

Though such a putter has achieved popularity and commercial success, there has been a continuing need for improvement.

SUMMARY OF THE INVENTION

In accordance with the invention there is provided a golf putter having a putter head and an elongated putter shaft. The putter head has a striking face, a sole, a centerline marker marking the desired area of putter to ball impact, a toe normally positioned remote from a user when in play and a heel opposite said toe. The elongated putter shaft has a grip on one end and, at an opposite end, attached to the putter head between the center line marker and the toe, the putter shaft having a transverse marking which lines up vertically with the center line marker on the putter head when a user is holding the putter in a putting position with the golfer's eyes over the center line marker of the putter head.

Preferably, the centerline marker is perpendicular to the striking face and is vertically aligned with the desired area of putter to ball impact of the putter head.

Advantageously, the putter shaft extends across the putter head from proximate the toe towards the heel at an acute angle with the sole of the putter head, crossing the center line of the putter head.

The transverse marking on the shaft marks the center of gravity of the shaft when the putter is in the putting position.

The putter shaft may extend up from putter head, when said putter is in the putting position and then angle towards the golfer.

In another aspect of the invention there is provided a method of aligning a putter and a golfer's eyes to a putter head (and, therefore the golf ball) and a desired line of travel, which includes providing a putter which has a shaft attached proximate a toe of a putter head and at least a portion of which shaft angles back towards a golfer when the golfer and the shaft are in the putting position. The method further includes placing a center line marker over the desired area of cutter to ball impact of the putter head, and placing a marker on an upper side of the shaft of the putter which vertically aligns with the center line marker when the putter is in the putting position; and holding the putter in the putting position and then aligning a golfer's eyes with the aligned mark on the shaft and the center line mark on the putter head such that the putter head is perpendicular to the desired direction of travel of the golf ball.

BRIEF DESCRIPTION WITH REFERENCE TO THE DRAWINGS

Further features and advantages will be apparent from the following detailed description, given by way of example, of a preferred embodiment taken in conjunction with the accompanying drawings, wherein.

DETAILED DESCRIPTION WITH REFERENCE TO THE DRAWINGS

Figure 1:
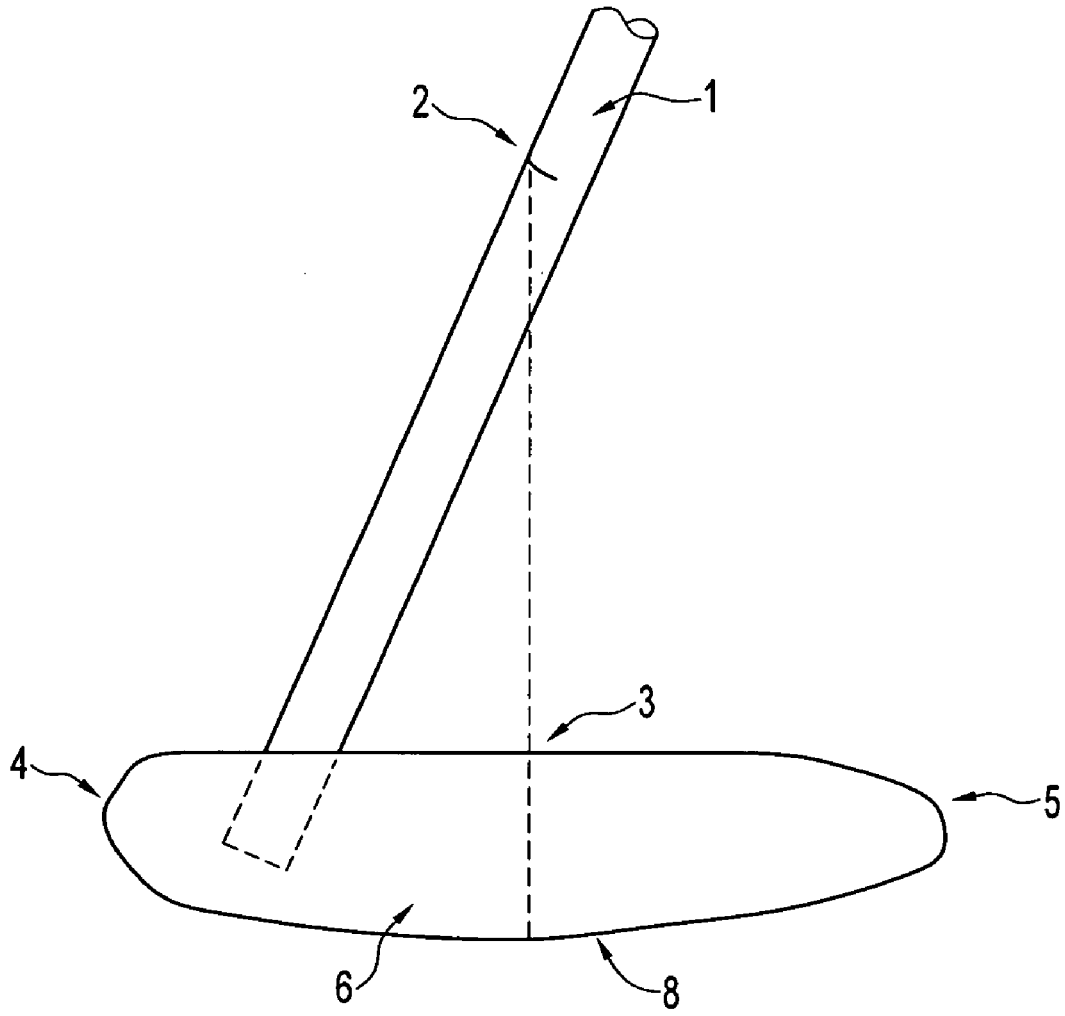
FIG. 1 is a elevation view showing the putter head and a portion of the putter shaft.
Figure 2:
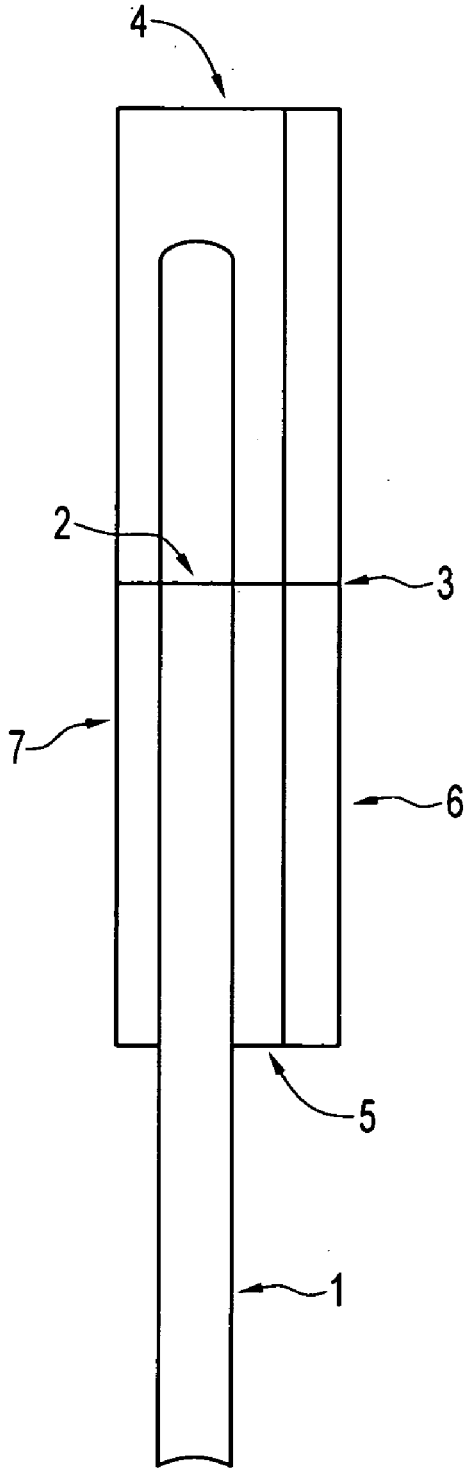
FIG. 2 is a top view of the putter head and a portion of the putter shaft showing the shaft mark and the center line mark on the putter head.

Referring to FIGS. 1 and 2, a putter shaft 1 is attached to a putter head 6 proximate a toe 4 of the putter head 6. The putter head also has a heel 5, a sole 8 and a center line mark 3 over the desired area of cutter to ball impact of the putter head 6. A mark 2 on the upper side of the shaft 1 is placed so that with the putter in a putting position, the mark 2 is aligned with the center line mark 3 on the top of the putter head 6. The mark on the top of the putter head is perpendicular to a strike face 7 of the putter head 6. The shaft extends from its point of attachment proximate the toe 4 across the center line mark 3 towards a golfer when in the putting position.

Figure 3:
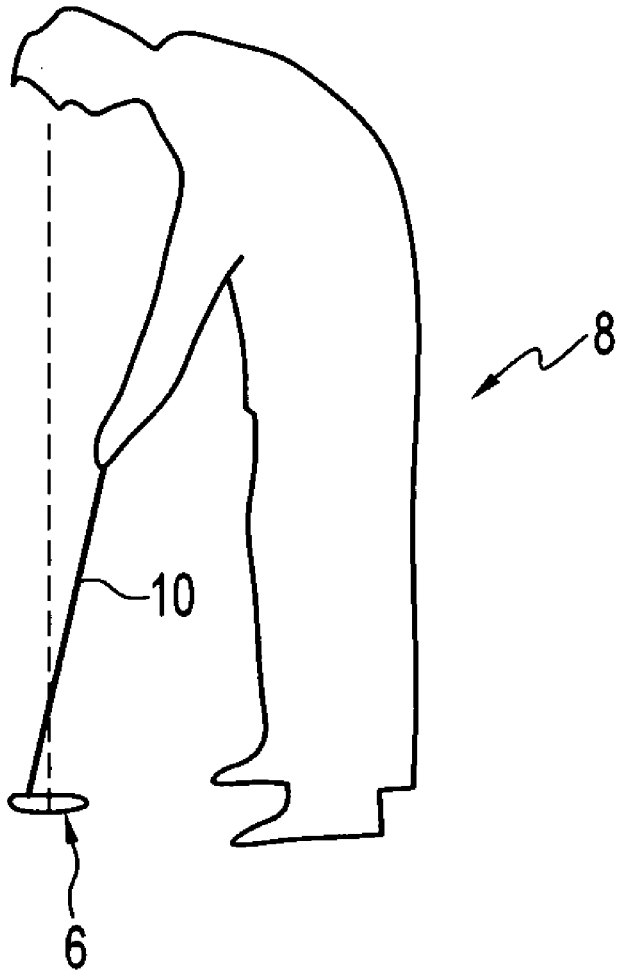
FIG. 3 is an elevation view showing a golfer with his eyes aligned with the center line mark on the putter head and the mark on the shaft.

Referring to FIG. 3, a golfer 8 is positioned over a putter 10, with the golfer's eyes over the marks on the shaft and the head 6. Complete alignment is achieved once the strike face 7 is placed perpendicular to the desired direction of travel of a golf ball.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

I claim:

1. A golf putter, comprising:

(a) a putter head having a striking face, a sole, a centerline marker marking a desired area of putter to ball impact, a toe positioned remote from a user when said putter is in play, and a heel opposite said toe; and (b) a shaft having a grip on one end and, at an opposite end being attached to said putter head between the centerline marker and said toe, said shaft having a transverse marking thereon;

wherein said centerline marker and said transverse marking are positioned such that they both lie on a straight line perpendicular to a putting surface when the user addresses a golf ball at rest on the putting surface; and wherein visual alignment of said centerline marker and said transverse marker by the user indicates that eyes of the user are over the ball.

2. The golf putter according to claim 1, wherein the centerline marker is perpendicular to the striking face and is vertically aligned with the desired area of putter to ball impact of said putter head.

3. The golf putter according to claim 1, wherein said putter shaft extends from proximate said toe at an acute angle with the sole of said putter head, crossing the center line of said putter head.

* * * * *

UNITED STATES PATENT AND TRADEMARK OFFICE

CERTIFICATE OF CORRECTION

PATENT NO. : 7,066,829 B1
APPLICATION NO. : 10/019435
DATED : June 27, 2005
INVENTOR(S) : Gary R. Lister It is certified that error appears in the above-identified patent and that said Letters Patent is hereby corrected as shown below:

Col. 2, Line 35, replace “cutter” with --putter--
Col. 2, Line 66, replace “cutter” with --putter--

Signed and Sealed this

Twelfth Day of December, 2006

JON W. DUDAS
*Director of the United States Patent and Trademark Office*

UNITED STATES PATENT AND TRADEMARK OFFICE

CERTIFICATE OF CORRECTION

PATENT NO. : 7,066,829 B1
APPLICATION NO. : 10/019435
DATED : June 27, 2006
INVENTOR(S) : Gary R. Lister It is certified that error appears in the above-identified patent and that said Letters Patent is hereby corrected as shown below:

Col. 2, Line 35, replace “cutter” with --putter--
Col. 2, Line 66, replace “cutter” with --putter--

This certificate supersedes Certificate of Correction issued December 12, 2006.

Signed and Sealed this

Ninth Day of January, 2007

JON W. DUDAS
*Director of the United States Patent and Trademark Office*